US008516981B2

(12) United States Patent
Jacques et al.

(10) Patent No.: US 8,516,981 B2
(45) Date of Patent: Aug. 27, 2013

(54) ENGINE ASSEMBLY INCLUDING CAM PHASER WITH DUAL LOCK POSITION

(75) Inventors: Robert Lionel Jacques, Troy, MI (US); James Tuttle, Rochester Hills, MI (US)

(73) Assignee: GM Global Technology Operations LLC

( * ) Notice: Subject to any disclaimer, the term of this patent is extended or adjusted under 35 U.S.C. 154(b) by 667 days.

(21) Appl. No.: 12/607,148

(22) Filed: Oct. 28, 2009

(65) Prior Publication Data

US 2011/0094466 A1 Apr. 28, 2011

(51) Int. Cl.
*F01L 1/34* (2006.01)

(52) U.S. Cl.
USPC ..... 123/90.17

(58) Field of Classification Search
USPC ..... 123/90.17, 90.15; 464/160, 161; 74/568 R
See application file for complete search history.

(56) References Cited

U.S. PATENT DOCUMENTS 5,816,204 A * 10/1998 Moriya et al. ..... 123/90.17
5,924,395 A * 7/1999 Moriya et al. ..... 123/90.15
6,311,655 B1 * 11/2001 Simpson et al. ..... 123/90.17

* cited by examiner

*Primary Examiner* — Thomas Denion
*Assistant Examiner* — Daniel Bernstein
(74) *Attorney, Agent, or Firm* — Harness, Dickey & Pierce, P.L.C.

(57) ABSTRACT

A cam phaser assembly may include a stator assembly, a rotor assembly, and a lock assembly. The stator assembly may be rotationally driven by an engine crankshaft. The rotor assembly may be engaged with the stator assembly and fixed for rotation with an engine camshaft. The rotor assembly may include a radially extending vane located within a recess of the stator assembly to define advance and retard chambers receiving pressurized fluid to rotationally displace the rotor assembly. The lock assembly may be engaged with the stator assembly and the rotor assembly during first and second operating conditions. The lock assembly may include a lock pin mechanically securing the rotor assembly in a rotationally advanced position relative to the stator assembly during the first operating condition and mechanically securing the rotor assembly in a rotationally retarded position relative to the stator assembly during the second operating condition.

3 Claims, 6 Drawing Sheets

ENGINE ASSEMBLY INCLUDING CAM PHASER WITH DUAL LOCK POSITION

FIELD

The present disclosure relates to engine assemblies, and more specifically to engine cam phaser assemblies.

BACKGROUND

This section provides background information related to the present disclosure which is not necessarily prior art.

Internal combustion engines include one or more camshafts for actuation of intake and exhaust valves. Cam phasers may be coupled to the camshafts to adjust valve timing. Cam phasers provide for relative rotation of a camshaft relative to a camshaft drive during operation to vary valve timing. Relative rotation of the camshaft may be attained by applying a hydraulic fluid to chambers defined in the cams phaser. However, the cam phasers may not be able to be maintained in a desired position when the pressure of the hydraulic fluid within the chambers is below a required level.

SUMMARY

A cam phaser assembly may include a stator assembly, a rotor assembly, and a lock assembly. The stator assembly may be rotationally driven by an engine crankshaft. The rotor assembly may be engaged with the stator assembly and fixed for rotation with an engine camshaft. The rotor assembly may include a radially extending vane located within a recess of the stator assembly to define advance and retard chambers on opposite sides of the vane receiving pressurized fluid to rotationally displace the rotor assembly relative to the stator assembly. The lock assembly may be engaged with the stator assembly and the rotor assembly during first and second operating conditions. The lock assembly may include a lock pin mechanically securing the rotor assembly in a rotationally advanced position relative to the stator assembly during the first operating condition and mechanically securing the rotor assembly in a rotationally retarded position relative to the stator assembly during the second operating condition.

The cam phaser may be included in a powertrain assembly. The powertrain assembly may include an engine assembly including an engine structure rotationally supporting a camshaft having the cam phaser coupled thereto. The powertrain assembly may additionally include a hybrid power assembly that propels a hybrid vehicle during a first operating mode. The engine assembly may propel the hybrid vehicle during a second operating mode.

A method of controlling the hybrid vehicle may include commanding the engine to be shut off during vehicle operation. Atmospheric pressure may be determined at a time corresponding to the commanded engine shut off. The camshaft may be locked in a retarded position via the cam phaser when the determined atmospheric pressure is above a predetermined limit. The engine may be shut off after the locking.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
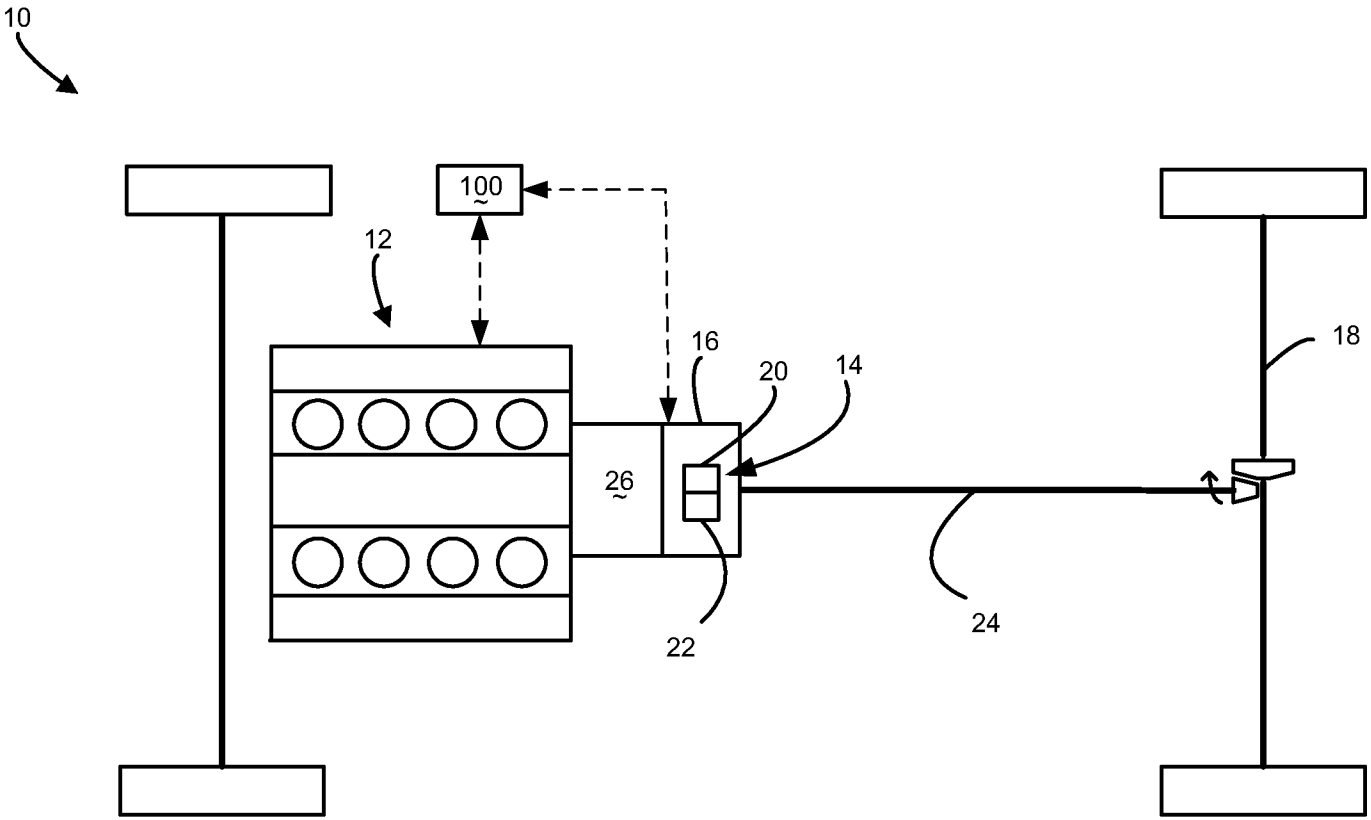
FIG. 1 is schematic illustration of a hybrid vehicle according to the present disclosure.

With reference to FIG. 1, a hybrid vehicle assembly 10 is schematically illustrated. The hybrid vehicle assembly 10 may include an engine assembly 12, a hybrid power assembly 14, a transmission 16 and a drive axle 18. The engine assembly 12 and the hybrid power assembly 14 may form a powertrain assembly. The hybrid power assembly 14 may include an electric motor 20 and a rechargeable battery 22. The electric motor 20 and rechargeable battery 22 may form a drive mechanism for the hybrid power assembly 14. The motor 20 may be in electrical communication with the battery 22 to convert power from the battery 22 to mechanical power. The motor 20 may additionally be powered by the engine assembly 12 and operated as a generator to provide power to charge the battery 22. The hybrid power assembly 14 may be incorporated into and engaged with the transmission 16. The motor 20 may be coupled to an output shaft 24 to power rotation of the drive axle 18 via the transmission 16.

The engine assembly 12 may be coupled to the transmission 16 via a coupling device 26 and may drive the transmission 16. The coupling device 26 may include a friction clutch or a torque converter. The transmission 16 may use the power provided from the engine assembly 12 and/or the motor 20 to drive the output shaft 24 and power rotation of the drive axle 18.

Figure 2:
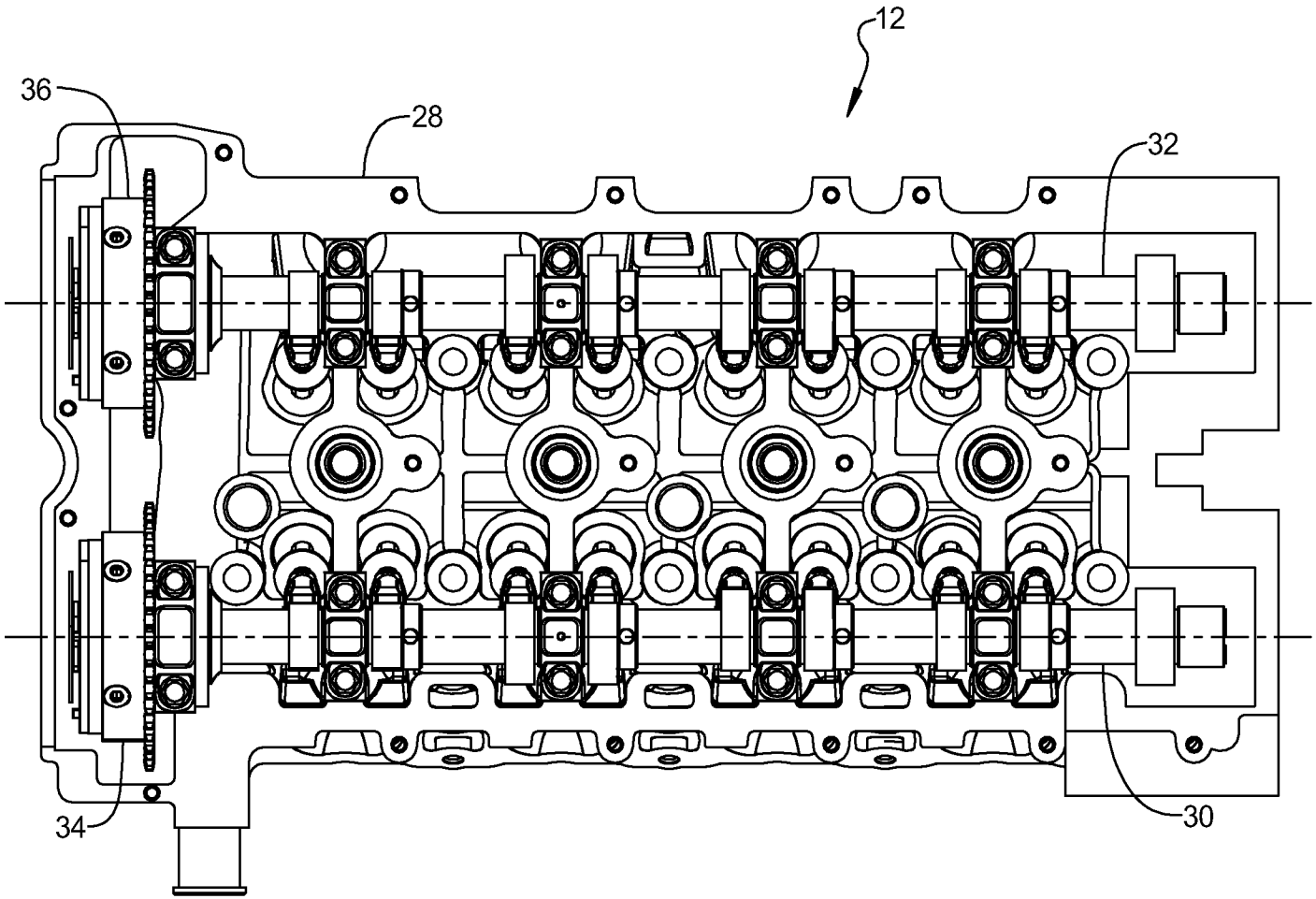
FIG. 2 is an illustration of a portion of the engine assembly shown in FIG. 1.

With reference to FIG. 2, the engine assembly 12 may include an engine structure 28, intake and exhaust camshafts 30, 32 rotationally supported on the engine structure 28, and intake and exhaust cam phasers 34, 36. The intake cam phaser 34 may be coupled to the intake camshaft 30 and the exhaust cam phaser 36 may be coupled to the exhaust camshaft 32. In the present non-limiting example, the engine assembly 12 is shown as a dual overhead camshaft engine where the engine structure 28 supporting the camshafts 30, 32 is a cylinder head. However, the present disclosure is not limited to dual overhead camshaft arrangements and applies equally to single overhead camshaft engines as well as cam-in-block engines.

Figure 3:
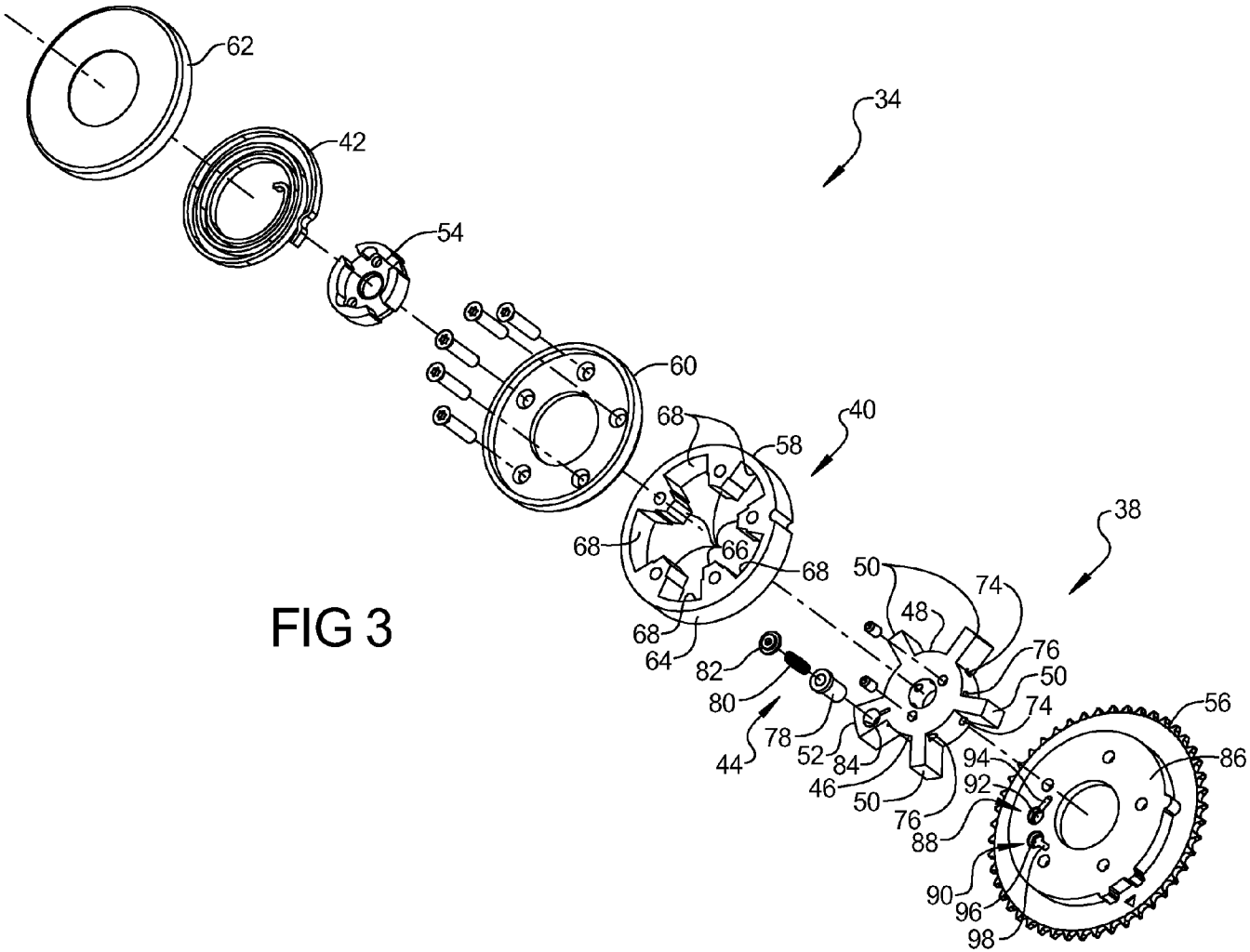
FIG. 3 is an exploded view of the cam phaser shown in FIG. 2.
Figure 5:
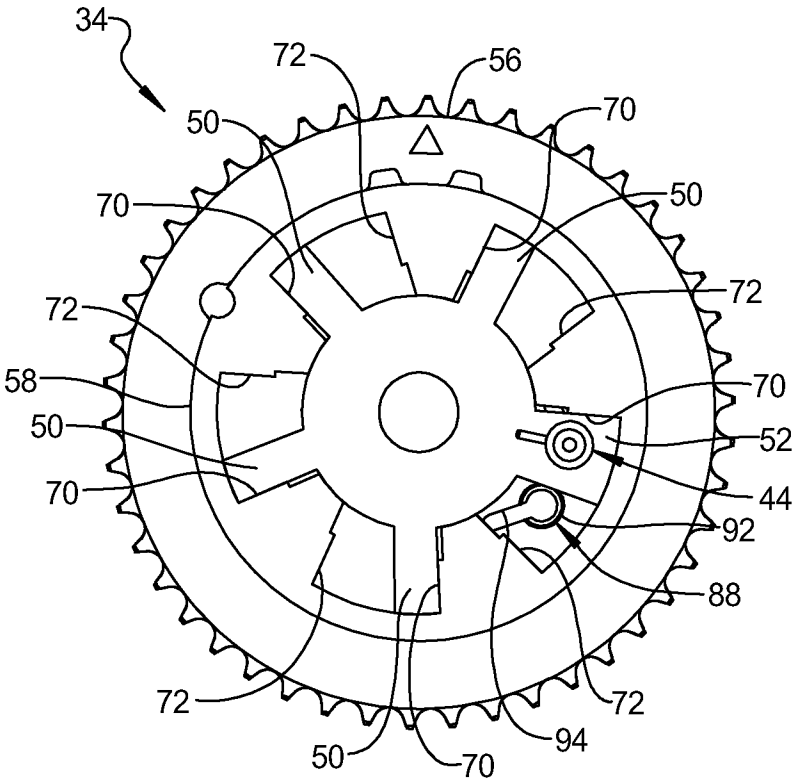
FIG. 5 is a schematic illustration of the cam phaser of FIG. 3 in a second locked position.
Figure 4:
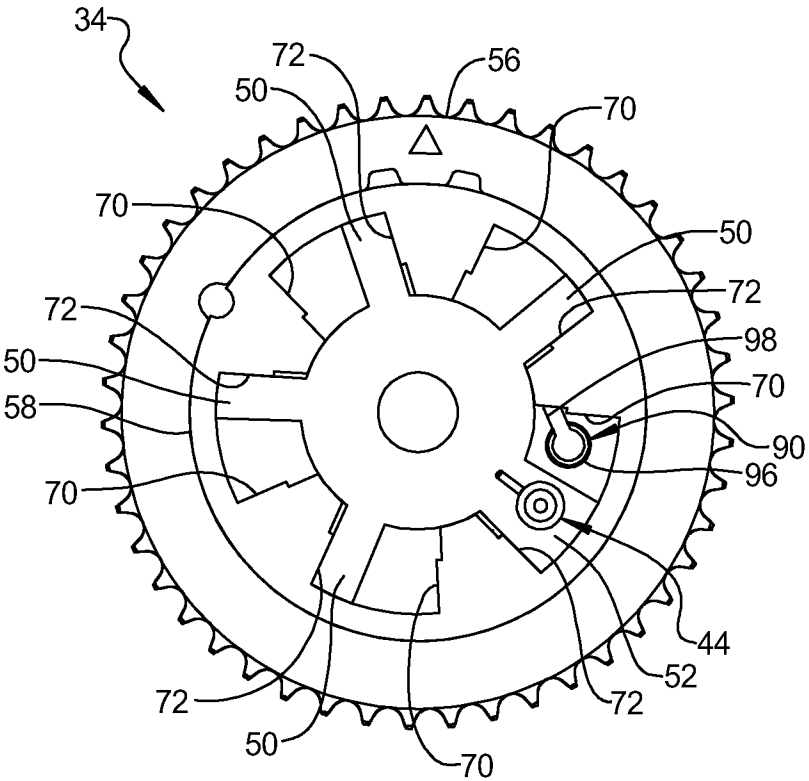
FIG. 4 is a schematic illustration of the cam phaser of FIG. 3 in a first locked position.

As seen in FIGS. 3-5, the intake cam phaser 34 may include a rotor assembly 38, a stator assembly 40, a biasing member 42 and a lock assembly 44. The rotor assembly 38 may include a first member 46 having a central body 48 with vanes 50, 52 extending radially outward therefrom and a second member 54 fixed for rotation with the first member 46. The first member 46 may be fixed for rotation with the intake camshaft 30. The stator assembly 40 may include a driven member 56, a rotor housing member 58 and cover members 60, 62. The rotor housing member 58 and the cover members 60, 62 may be fixed for rotation with the driven member 56. The driven member 56 may be rotationally driven by an engine crankshaft (not shown) via a belt, gear, or chain drive. The biasing member 42 may include a torsional spring engaged with the second member 54 of the rotor assembly 38 and the stator assembly 40 to rotationally bias the rotor assembly 38, and therefore the intake camshaft 30, relative to the stator assembly 40.

The rotor housing member 58 may include an annular body 64 having protrusions 66 extending radially inward therefrom. Recesses 68 may be defined circumferentially between adjacent ones of the protrusions 66. The first member 46 of the rotor assembly 38 may be located within the annular body 64 of the rotor housing member 58 with the vanes 50, 52 extending into the recesses 68 to separate the recesses 68 into advance and retard chambers 70, 72. The driven member 56 and cover member 60 may cooperate with the rotor housing member 58 and first member 46 of the rotor assembly 38 to define axial ends of the advance and retard chambers 70, 72. During operation, pressurized fluid, such as oil, may be provided to the advance or retard chambers via advance and retard passages 74, 76 in the first member 46 of the rotor assembly 38 to rotationally displace the intake camshaft 30 between advanced and retarded positions. The advanced position is illustrated in FIG. 4 and the retarded position is illustrated in FIG. 5.

The lock assembly 44 may secure the rotor assembly 38, and therefore the intake camshaft 30 in an advanced position or a retarded position based on operating conditions, as discussed below. The lock assembly 44 may include a lock pin 78, a biasing member 80 and stop 82. The vane 52 may define an aperture 84 extending axially therein housing the lock assembly 44. The biasing member 80 may include a compression spring located between the stop 82 and the lock pin 78, urging the lock pin 78 toward the driven member 56.

An axial end surface 86 of the driven member 56 facing the first member 46 of the rotor assembly 38 may include an advance lock recess 88 and a retard lock recess 90. The advance lock recess 88 may include a first portion 92 for receiving the lock pin 78 and a second portion 94 defining a fluid passage between the first portion 92 and an adjacent one of the advance chambers 70. The retard lock recess 90 may include a first portion 96 for receiving the lock pin 78 and a second portion 98 defining a fluid passage between the first portion 96 and an adjacent one of the retard chambers 72. While discussed with respect to the intake cam phaser 34, it is understood that the present disclosure may additionally apply to the exhaust cam phaser 36.

The vehicle 10 may additionally include a control module 100 that commands operation of the intake cam phaser 34 based on operating conditions. As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality. The control module 100 may control operating modes of the hybrid vehicle assembly 10.

In a first operating mode, the engine assembly 12 may drive the output shaft 24. In a second operating mode, the engine assembly 12 may be decoupled from the transmission 16 and the electric motor 20 may drive the output shaft 24. The engine assembly 12 may be shut off during the second operating mode. In a third operating mode, the engine assembly 12 may be driven by the electric motor 20 to provide pressurized fluid to the intake cam phaser 34. By way of non-limiting example, the electric motor 20 may drive rotation of a crank-driven oil pump by driving rotation of the crankshaft to provide the pressurized fluid.

Figure 6:
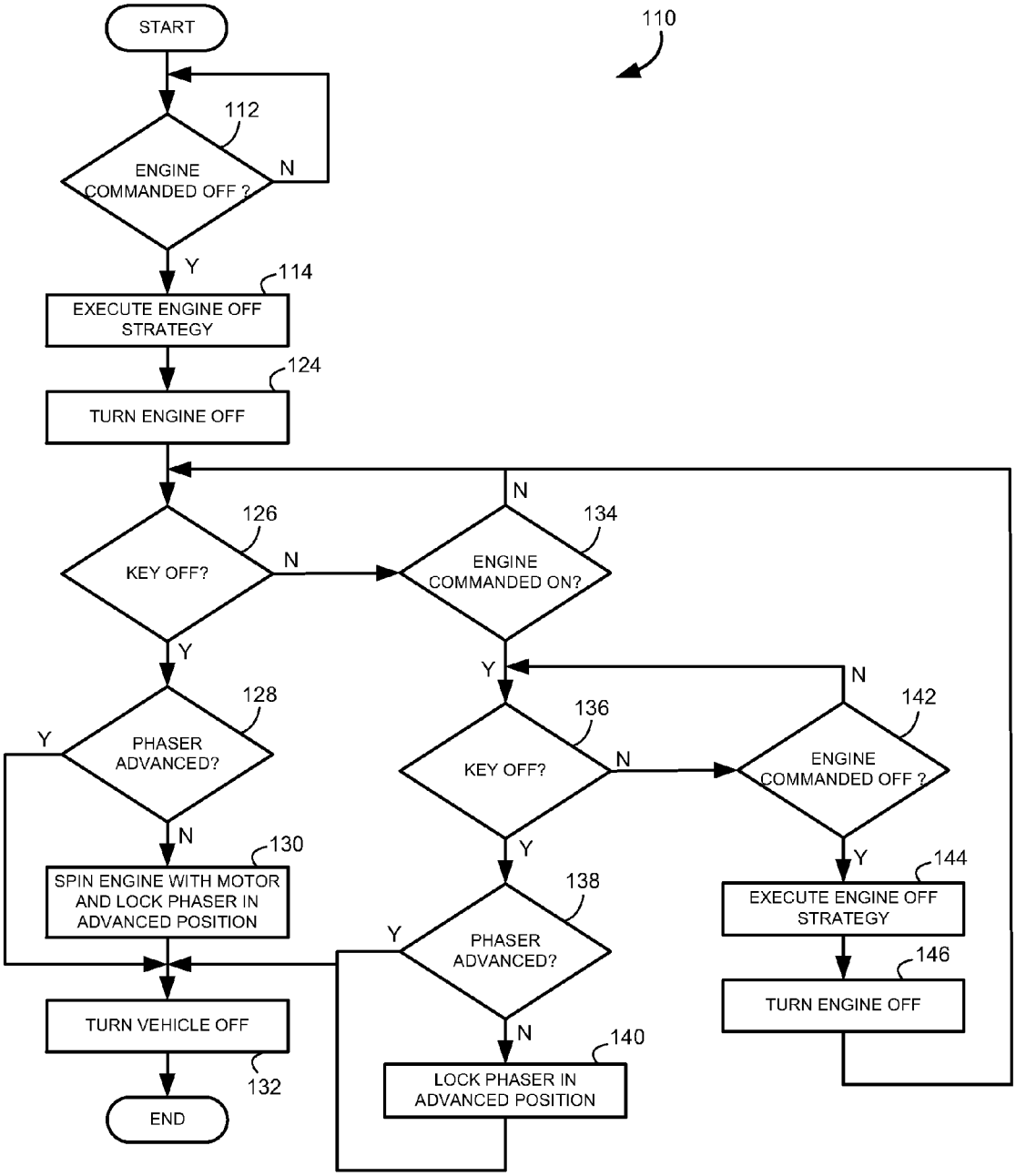
FIG. 6 is a flow chart illustrating a control strategy for the hybrid vehicle of FIG. 1.
Figure 7:
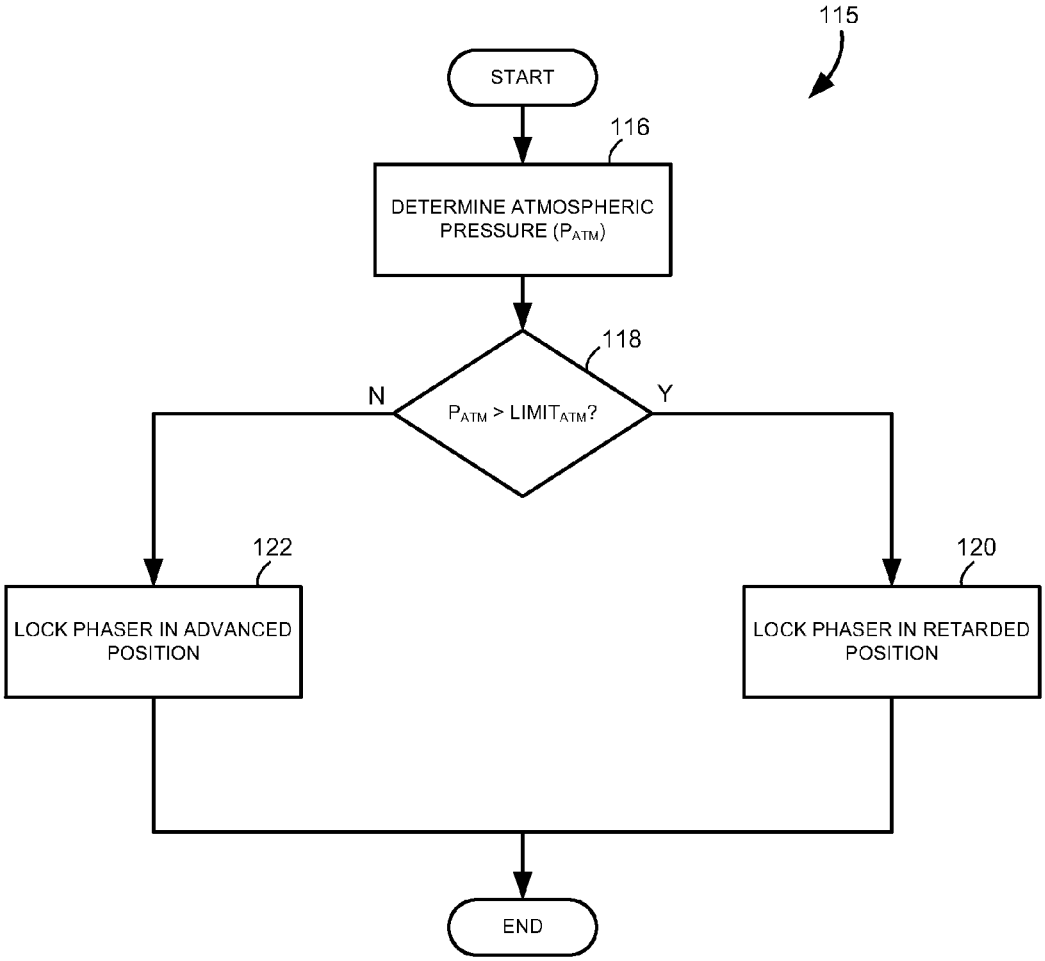
FIG. 7 is an additional flow chart illustrating the control strategy for the hybrid vehicle of FIG. 1.

Exemplary control logic 110 for cam phaser operation is illustrated in FIGS. 6 and 7. With reference to FIG. 6, control logic 110 may begin after a vehicle key-on condition and an initial engine on condition (i.e., operation in the first operating mode). The initial engine on condition may include the engine being started with the intake cam phaser 34 locked in the full advanced position. Control logic 110 may evaluate the desired operating mode at block 112. If the hybrid vehicle 10 maintains operation with the engine on (i.e, first operating mode), control logic 110 may return to block 112 where operation of the hybrid vehicle 10 is again evaluated until the engine is commanded to be shut off. When the engine is commanded to be shut off (i.e, second operating mode), control logic 110 may proceed to block 114 where an engine off strategy is executed.

As seen in FIG. 7, the engine off strategy 115 includes determining atmospheric pressure ($P_{ATM}$) at block 116 and then evaluating the atmospheric pressure ($P_{ATM}$) at block 118. If the atmospheric pressure ($P_{ATM}$) is greater than a predetermined limit ($LIMIT_{ATM}$), the intake cam phaser 34 is locked in the retarded position at block 120. If the atmospheric pressure ($P_{ATM}$) is less than or equal to the predetermined limit ($LIMIT_{ATM}$), the intake cam phaser 34 is locked in the advanced position at block 122. The predetermined limit ($LIMIT_{ATM}$) may be less than 75 kilopascals (kPa). By way of non-limiting example, the predetermined limit ($LIMIT_{ATM}$) may generally correspond to low atmospheric pressure at high altitude. Starting the engine 12 with the intake cam phaser 34 in the retarded position may provide reduced cranking compression at start-up during start-stop operation of the hybrid vehicle 10. Initial starting of the engine 12 with the intake cam phaser 34 advanced may accommodate emissions requirements.

Referring back to FIG. 6, after execution of the engine off strategy, the engine 12 may be shut off at block 124. Control logic 110 may then evaluate vehicle operation at block 126. If vehicle key off (vehicle is commanded off by the user) occurs while the engine 12 is off, control logic 110 may evaluate the position of the intake cam phaser 34 at block 128. If the intake cam phaser 34 is locked in the advanced position, control logic 110 may proceed to block 132 where the vehicle is turned off. If the intake cam phaser 34 is not locked in the advanced position, control logic 110 may proceed to block 130 where the electric motor 20 is used to lock the intake cam phaser in the advanced position. By way of non-limiting example, the electric motor 20 may drive rotation of a crank-driven oil pump by driving rotation of the crankshaft to provide the pressurized fluid and the control module 100 may command the intake cam phaser 34 to the advanced position where the lock pin 78 engages the advance lock recess 88 to fix the intake cam phaser 34 in the advanced position for a subsequent vehicle start.

If block 126 determines that continued vehicle operation is desired, control logic 110 proceeds to block 134 where operation of the hybrid vehicle 10 is again evaluated. If the engine 12 is maintained in the off condition, control logic 110 returns to block 126. If the engine 12 is commanded on, control logic 110 proceeds to block 136 where operation of the hybrid vehicle 10 is again evaluated. If vehicle key off (vehicle is commanded off by the user) occurs while the engine 12 is on, control logic 110 may evaluate the position of the intake cam phaser 34 at block 138. If the intake cam phaser 34 is locked in the advanced position, control logic 110 may proceed to block 132 where the vehicle is turned off. If the intake cam phaser 34 is not locked in the advanced position, control logic 110 may proceed to block 140 where the intake cam phaser 34 is locked in the advanced position. Control logic 110 may then proceed to block 132 where the vehicle 10 is turned off.

If block 136 determines that continued vehicle operation is desired, control logic 110 proceeds to block 142 where operation of the hybrid vehicle 10 is again evaluated. If engine operation is maintained, control logic 110 may return to block 136. If the engine 12 is commanded off, control logic 110 may proceed to block 144 where the engine off strategy 115 shown in FIG. 7 is again executed. Control logic 110 may then proceed to block 146 where the engine is shut off. Control logic 110 may then return to block 126.

What is claimed is:

1. A powertrain assembly for a hybrid vehicle comprising:

an engine structure for propelling the hybrid vehicle in a first operating mode;

a hybrid power assembly including an electric motor and a rechargeable battery for propelling the hybrid vehicle during a second operating mode;

an intake camshaft rotationally supported on the engine structure; and a cam phaser assembly coupled to the camshaft and including:

a stator assembly rotationally driven by an engine crankshaft;

a rotor assembly engaged with the stator assembly and fixed for rotation with the camshaft, the rotor assembly including a radially extending vane located within a recess of the stator assembly defining advance and retard chambers on opposite sides of the vane adapted to receive pressurized fluid to rotationally displace the rotor assembly relative to the stator assembly; and a lock assembly engaged with the stator assembly and the rotor assembly during first and second operating conditions, the lock assembly including a single lock pin mechanically securing the rotor assembly in a rotationally advanced position relative to the stator during the first operating condition and mechanically securing the rotor assembly in a rotationally retarded position relative to the stator assembly during the second operating condition, wherein the cam phaser is locked in the retarded position during hybrid vehicle operation in the second operating mode, wherein the vane includes an aperture housing the single lock in and the stator assembly includes first and second recesses, the single lock in engaged with the first recess to mechanically secure the rotor assembly in the advanced position and engaged with the second recess to mechanically secure the rotor assembly in the retarded position, the first recess including a first portion for receiving the single lock in and a second portion defining a fluid passage between the first portion and the advance chamber and the second recess including a third portion for receiving the single lock in and a fourth portion defining a fluid passage between the third portion and the retard chamber, wherein the lock assembly includes a biasing member forcing the single lock pin axially into the first recess during the first operating condition and forcing the single lock in axially into the second recess during the second operating condition.

2. The powertrain assembly of claim 1, wherein the camshaft is locked in the retarded position when an atmospheric pressure is above a predetermined limit providing a predetermined cranking compression required for a re-start of the engine after vehicle operation in the second operating mode.

3. The powertrain assembly of claim 1, wherein the advanced position corresponds to a fully advanced position and the retarded position corresponds to a fully retarded position.

* * * * *